United States Patent [19]

Cleland

[11] Patent Number: 4,476,014

[45] Date of Patent: Oct. 9, 1984

[54] METHOD OF MAKING AN ORE CONCENTRATOR, AND CONCENTRATOR THUS MADE

[76] Inventor: Keith B. Cleland, 4460 Park Newport, Newport Beach, Calif. 92660

[21] Appl. No.: 323,171

[22] Filed: Nov. 19, 1981

[51] Int. Cl.[3] ..... B03B 5/52

[52] U.S. Cl. ..... 209/434; 156/92; 156/160; 156/196; 156/245; 156/267; 156/285; 209/444; 209/482; 264/220; 428/37

[58] Field of Search ..... 29/450, 451, 453; 156/91, 92, 160, 196, 299, 245, 267; 209/434, 444, 482; 428/32, 37; 264/220

[56] References Cited

U.S. PATENT DOCUMENTS

| | | | |
|---|---|---|---|
| 658,947 | 10/1900 | Goyne . | |
| 1,236,839 | 8/1917 | Hertzberg | 209/444 |
| 1,853,249 | 4/1932 | Ainlay . | |
| 1,986,778 | 1/1935 | Hinkley | 209/452 |
| 2,064,554 | 12/1936 | Mahoney et al. | 209/452 |
| 3,269,538 | 8/1966 | Stephan | 209/441 |
| 4,008,152 | 2/1977 | Kleven | 209/444 |
| 4,110,206 | 8/1978 | Kleven | 209/43 |
| 4,267,036 | 5/1981 | Kleven | 209/444 |

OTHER PUBLICATIONS

2 Page Flyer entitled "Simple Portable Affordable Automatic Planning".

1 Page Flyer entitled "Goldhound".

*Primary Examiner*—Robert Dawson

*Attorney, Agent, or Firm*—William W. Haefliger

[57] ABSTRACT

A method of effecting practical, simple and economical production of ore-concentrating pads of numerous configurations and sizes. Nails are employed to secure extruded strips to a backing sheet and an underlying support, following which the strips are pivoted about the nails and progressively secured to the backing sheet. The nails are then removed and the resulting pad is vacuum-applied to a concave bowl and adhesively secured therein. The shapes and positions of the strips are such that there is very close sealing engagement between adjacent strips, after the pad is made into bowl shape, yet there is great elasticity permitting practical vacuum application to the bowl. In one embodiment, the strip-formed pad is used as a mold over which plaster of paris is molded, and the plaster of paris is used as a guide for a tracing machine adapted to make a mold for the mass-manufacture of large numbers of concentrating pads.

15 Claims, 13 Drawing Figures

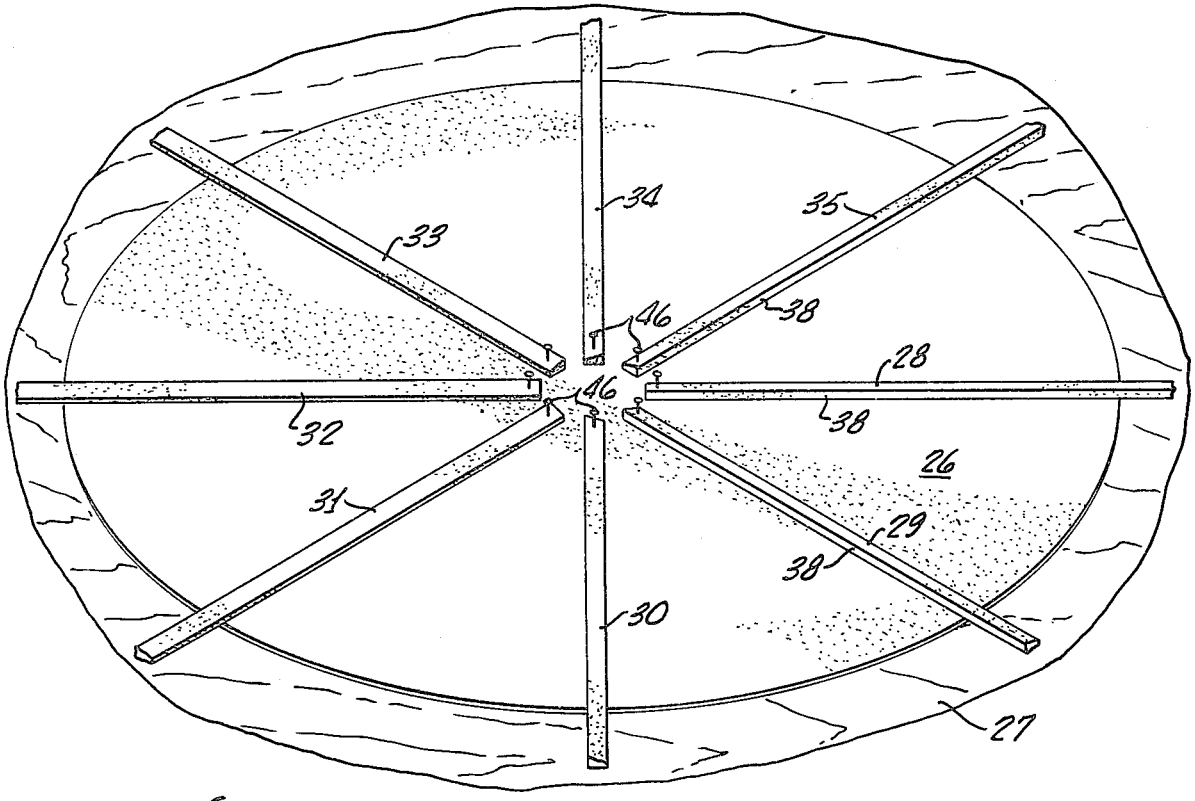
FIG. 2.
FIG. 3.
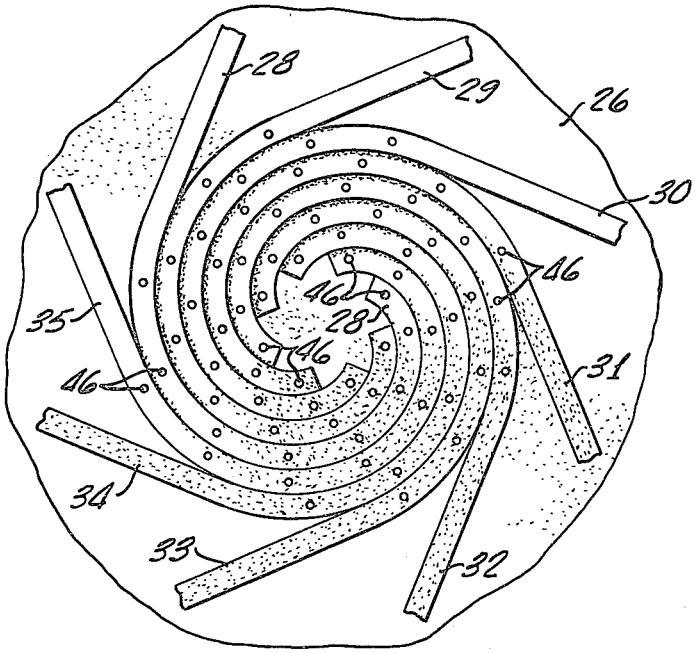
FIG. 9.
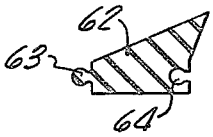
FIG. 10.
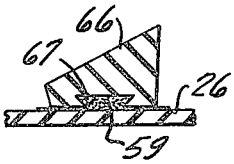

METHOD OF MAKING AN ORE CONCENTRATOR, AND CONCENTRATOR THUS MADE

BACKGROUND OF THE INVENTION

In patent application Ser. No. 212,902, filed Dec. 4, 1980, and now abandoned, there was shown and described a method and apparatus whereby strips of extruded rubber (or equivalent resilient, flexible material) were secured to a backing sheet and to each other. There was further described a method and apparatus whereby the interrelated strips, thus formed, were used to form a pattern which, in turn, was used for purposes including (among others) the orientation of further strips.

The last-mentioned method and apparatus have proved not commercially satisfactory, especially for the crucially-important large-diameter pads. Reasons for this include the fact that extrusions of rubber are not perfect but instead vary somewhat along their lengths.

Especially in large-diameter commercial apparatus intended to have a very large production rate, there must be many strips (called "leads") spiraling outwardly from the center. These leads must be closely spaced, and must touch each other for the apparatus to operate satisfactorily. Since the method whereby a pattern is employed to orient the leads has proved not commercially satisfactory, it has been a major problem to invent a method of manufacturing pads (especially large-diameter pads having many leads) in any practical and satisfactory manner.

The apparatus illustrated in the cited patent application has a flat bottom. However, round or upwardly-concave bottoms (and associated pads secured thereto) are known in the art. It is a major problem to effect mounting of a strip-formed ore-concentrating pad in an upwardly-concave bowl, again so that practical and satisfactory manufacturing of ore concentrators may be effected.

SUMMARY OF THE INVENTION

In accordance with one of its aspects, the invention comprises placing a plurality of strips, having predetermined cross-sectional shapes, on a thin, flexible and stretchable backing sheet which is, in turn, supported on an underlying support adapted to receive nails. Inner ends of the strips are nailed to the support, at predetermined locations, and closer to a predetermined center than is the desired internal diameter of the concentrating pad.

Thereafter, these nails are employed as pivot points, temporary securing points, and backup points while the various strips are secured to the backing sheet in spiral orientation and in close engagement with each other. A flexible cement is employed to effect permanent securing. Furthermore, other nails are employed at desired outwardly spaced locations along each strip because the strips are in a stressed condition due to the imposed flexure of the spiral.

In accordance with another aspect of the present invention, the pad formed as described above is removed from the nail receiver (the nails being removed) and applied to a bowl having a desired upwardly-concave configuration. To achieve this result, the pad and the bowl are disposed in a flexible bag, adhesive is applied to the bowl and/or to the underlying surface of the flexible sheet, and a vacuum is drawn on the bag.

Atmospheric pressure then pushes the pad into the bowl, and is maintained until the adhesive has cured. Thereafter, the interior portion of the pad is trimmed to circular shape conforming to the shape of a circular central hole in the bowl. Similarly, the outer edge of the pad is trimmed to conform to the peripheral region of the bowl. It is to be noted that only the thin backing rubber stretches and the strips themselves are in local compression at their outer portions, and are mutually spaced at their inner portions, these strips having reoriented themselves lengthwise thereof and also perpendicular to such lengthwise dimensions.

The thus-formed bowl-shaped concentrating pad assembly, which is another aspect of the invention, is then secured in an ore concentrating apparatus.

Very importantly, the flexible cement and the stretchable backing sheet, permit the pad to be vacuum-moved into the bowl in a practical manner, and without effecting cracking of any adhesive.

The configurations of the individual strips are such that the formation of the pad into concave shape causes an edge region of each strip to very tightly abut a side surface of an adjacent strip, for creation of an effective seal line. However, the regions of each two adjacent strips underlying the seal line separate to enhance the elasticity of the pad to allow it to grow in area, as desired for its vacuum mounting into the bowl. Special note is to be made that the area of the flat pad must be increased to cover the greater area of the concave bowl. (The area of a seven foot wheel, for example, is $\pi(3.5)^2$, while the area of a truncated sphere is greater than $\pi(3.5)^2$).

In accordance with a further aspect of the present invention, but one which is not preferred except for certain instances where relatively small-diameter pads are to be mass manufactured, the thus-formed pad is employed to mold a hardenable material, such as plaster of paris, thereover. The resulting plaster of paris is then used as a template in guiding a tracer-operated milling machine which makes a mold. The mold is then employed for compression molding large numbers of integral rubber pads.

BRIEF DESCRIPTION OF THE DRAWINGS

FIG. 2 is an isometric view of the first stages of the method of applying the strips to the backing sheet and underlying nail receiver;

FIG. 3 is a plan view showing how the strips are curved when progressively applied to the backing sheet and nail receiver;

FIGS. 9 and 10 are exemplary of other shapes of strips;

DETAILED DESCRIPTION OF THE PREFERRED EMBODIMENT

Figure 1:
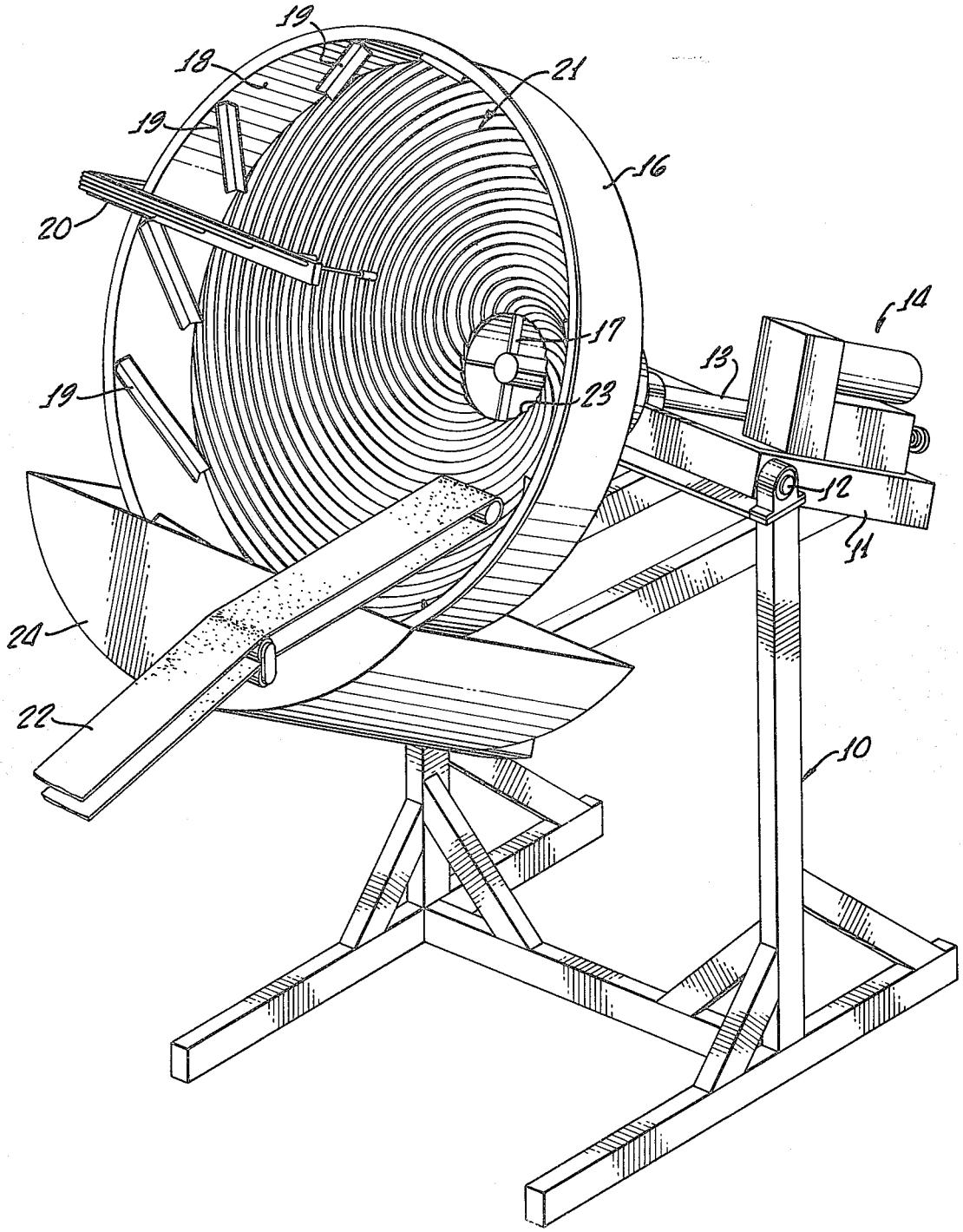
FIG. 1 is an isometric view of an ore-concentrating apparatus containing a pad and bowl assembly manufactured in accordance with the present invention.

Referring first to FIG. 1, the ore-concentrating apparatus is illustrated to comprise a frame or support 10 the upper portion 11 of which is pivotable about a horizontal axis 12 in order to adjust the inclination of a drive shaft 13. Such shaft, when driven by a motor assembly 14, effects rotation of a fiberglass shell 16 about an axis coincident with that of the shaft, the shell being connected to the shaft by a spider assembly 17. A hydraulic system, not shown, effects pivotal movement of shaft 13 and thus shell 16 about axis 12.

Telescoped into the forward portion of shell 16 is a rim 18 having blades 19, the blades and rim being secured to the shell by fasteners, not shown. Elements 18, 19 cooperate in effecting mounting in shell 16 of a concentrator-pad assembly 21 the construction of which is described in detail below. The construction and operation of the shell, rim 18, blades 19 and other elements are described in detail in my co-pending patent application filed on even date herewith. Such patent applications are hereby incorporated by reference herein as though set forth in full.

In operation, the motor assembly 14 drives the shaft 13 and shell 16 clockwise as viewed in FIG. 1. Simultaneously, ore (or other substance a component of which is to be concentrated) is conveyed into the drum by a conveyor 22. At the same time, lubrication water is sprayed toward the concentrator-pad 21 by spray apparatus 20 located at the position shown at the upper-left of FIG. 1.

Because of complex gravitational, frictional, and wave actions, the more dense components of the ore are caused to move toward the center of the concentrator-pad assembly and flow outwardly through a central opening 23 therein for collection by a suitable receiver, not shown. The less dense components of the ore or other substance flow forwardly over the forward edge of rim 18, and are received in a trough 24 and thus delivered to a suitable receptacle or region. For example, when the ore is gold ore, the gold particles and a small amount of dense (usually black) sand are delivered to central opening 23, whereas the less dense gravel and sand flow over the forward edge of rim 18 into the discharge trough 24.

The concentrator-pad assembly 21 is a highly crucial component of the apparatus. It is extremely difficult to manufacture, especially in the large sizes required for commercial production by large mines as distinguished from individual miners. The larger diameters, for example seven feet and more, increase output enormously. In addition, the number of grooves in the concentrating-pad assembly is important, since the greater number of grooves will create better ore separation and increased production. The shapes of the grooves and adjacent ridges may vary in accordance with the particular ore being concentrated.

It is therefore extremely important that a method of manufacture of the concentrator pad be employed which permits production of numerous types and sizes of pads at reasonable prices. For various reasons, this cannot be effected by molding of an entire integral pad, the cost of the molds and molding apparatus for such large sizes (and different types) being prohibitive. Applicant has now discovered methods of manufacturing the concentrator-pad assembly relatively quickly, and with no tooling cost, yet which creates a very effective and satisfactory pad.

Referring next to FIG. 2, a backing sheet 26 is illustrated, and comprises a thin sheet of rubber or other flexible and stretchable material. Backing sheet 26 is disposed flatwise on an underlying support 27 adapted to receive and hold nails. For example, support 27 may comprise a sheet of plywood. A plurality of flexible, resilient strips or "leads" 28–35, preferably extrusions of relatively soft rubber or the like, are secured to backing sheet 26 and support 27 in a particular, critical manner described subsequently.

Figure 5A:
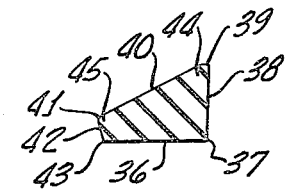
FIG. 5*a* is a sectional view of a single strip which has not been compressed or distorted.

Referring to FIG. 5*a*, there is a shown a sectional view representating any of the strips 28–35, all of such strips being identical in the illustrated embodiment which is the preferred form for use in the concentration of gold ore and certain other ores. As previously indicated, each strip is extruded of rubber or equivalent material. The bottom surface of each strip is numbered 36 in FIG. 5*a*, and such surface meets at a corner 37 an upwardly-extending surface 38 the height of which is relatively large. Surface 38 is generally perpendicular to surface 36. At corner 39, surface 38 meets an inclined surface 40, the latter sloping downwardly to a corner 41. Extending between corners 41 and 43 is a relatively small-dimension surface 42.

As illustrated, surface 42 is not perpendicular to surface 36, instead extending at an obtuse angle thereto, which angle is substantially greater than ninety degrees. It is to be understood that each of the "corners" 37, 39, 41 and 43 is actually an elongated, continuous edge.

The configuration described in FIG. 5*a* may be thought of as comprising two "teeth" 44 and 45. The first-mentioned tooth, 44, is large and is operative in the ore-concentration operation, aiding in defining grooves between adjacent ones of the tooth-shaped extrusions. The second of the teeth, number 45, is small and is not itself adapted to define a groove relative to an adjacent strip, being instead functional in making a seal relative thereto. The indicated seal, described below, is effective in preventing even minute particles of gold or other valuable material being recovered from moving downwardly toward the plane of bottom surface 36 and thus being lost in the concentrating pad.

Referring again to FIG. 2, the eight strips 28–35 (it being understood that more or less strips could be employed) are mounted generally radially on backing sheet 26 and at equal angles about the circumference of such sheet. Thus, in the illustrated example, the angle between each two adjacent radial strips is forty-five degrees.

The inner end of each strip is nailed, by a nail 46, to the sheet 26 and the underlying nail receiver 27. The inner ends of the strips are closer to the center of the arrangement (the place where hypothetical extensions of all of the strips converge) than is the sidewall of opening 23 shown in FIG. 1. All of the strips are arranged correspondingly to each other, for example with all of the surfaces 38 on the advance side of a wheel (FIG. 2) thought of as rotating clockwise. It is emphasized that all of the strips 28–35 are long, only the inner portions being shown in FIG. 2.

The nails 46 are placed in a circle about the common center, the diameter of the circle being less than the diameter of the opening 23 (FIG. 1). The nails are equally spaced about such circle, sufficiently far apart that there are gaps between the strips. The diameter of the circle about which the nails are spaced is related to the number of strips to be used in the manufacture of a particular concentrating pad assembly. If there are to be many strips, for example, several times more than those illustrated in FIG. 2, then the circle is necessarily greatly larger than what is illustrated in FIG. 2, in order to accommodate the widths of the strips. Conversely, if there are to be only a few strips or leads, as is not normally desired, then the diameter of the circle about which the nails are spaced will be smaller.

Referring next to FIG. 3, each strip 28–35 is bent clockwise (in the illustrated example) and caused to become and remain in close engagement with the adjacent strip. This is effected by closely-spaced nails and by flexible adhesive. During this step, the nails act as pivot points and, also, as attachments for the strips. Furthermore, the nails at at least the inner ends of the strips act as backup points preventing undesired movement as outer strip regions are pressed toward the center. As the result of such bending, the rubber at the outer portion of the bend stretches whereas as that at the inner portion compresses. A complex volute thus is commenced. The various strips are maintained secured to the backing sheet 26 by flexible adhesive, preferably rubber cement. Furthermore, additional nails 46 must be employed because the whole system wishes to uncoil like a stressed spring.

Figure 4:
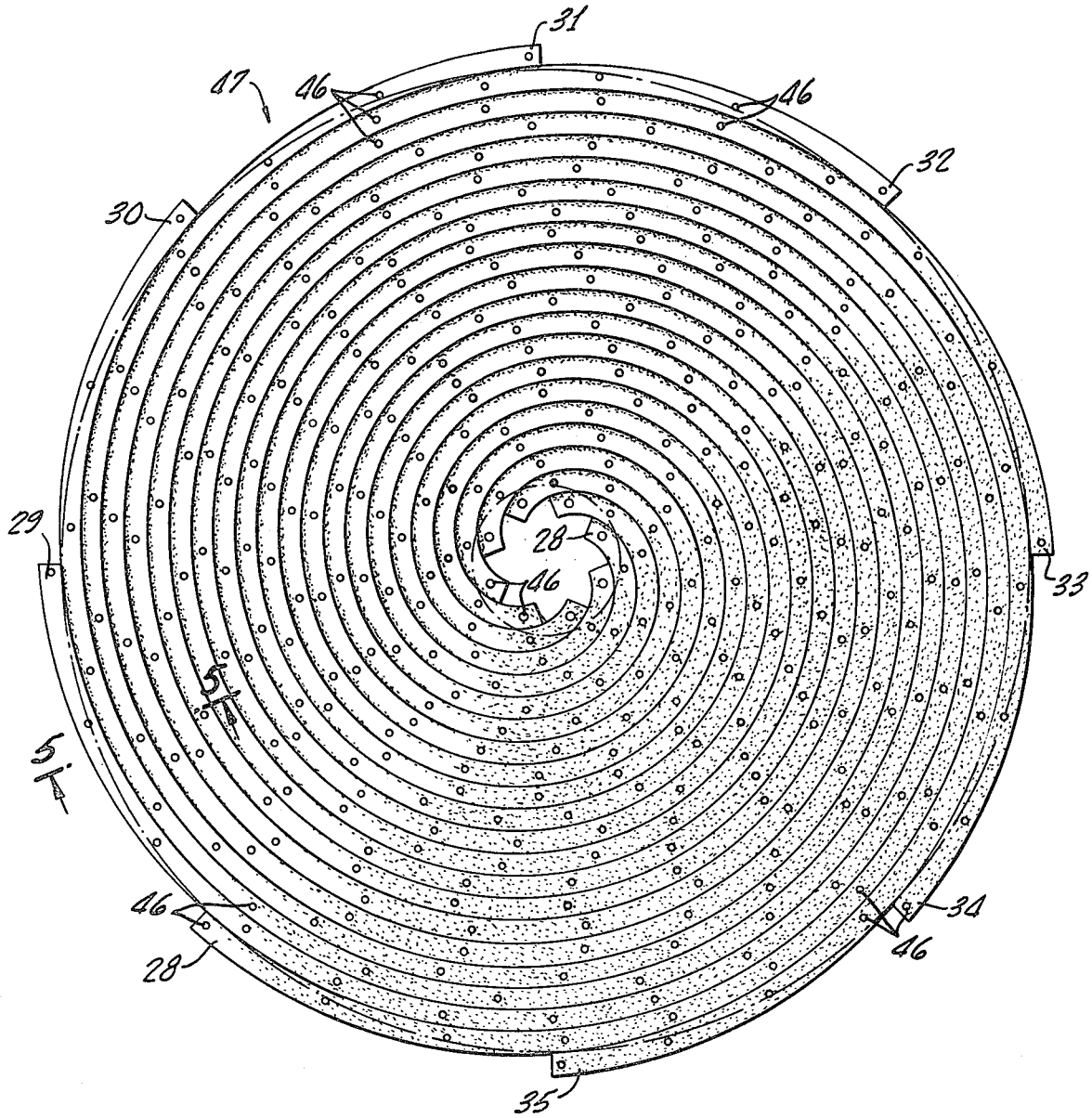
FIG. 4 is a plan view corresponding to FIG. 3 but showing a later stage in the method.

Referring next to FIG. 4, the bending and securing process is continued until there is completed a pad 47 having a diameter sufficiently large that, after the pad is inserted into a bowl described subsequently, the periphery of the pad will overlap the periphery of the bowl.

Figure 5:
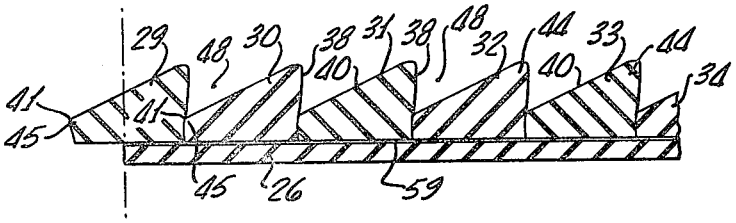
FIG. 5 is a vertical sectional view, on line 5—5 of FIG. 4, showing how the strips engage each other when disposed on a backing sheet which is in planar configuration.

As shown in section in FIG. 5, the strips are tightly adjacent each other, preferably such that the small teeth 45 (formed adjacent corners or edges 41) indent somewhat into the surfaces 38. The large teeth 44 (defined by surfaces 40 and 38) extend upwardly from backing sheet 26, and define between them grooves 48 adapted to receive ore as the concentrator-pad assembly 21 (FIG. 1) rotates.

As the next step in the method, the various nails 46 are removed, following which the thus-formed pad 47 is disposed in a large air-impervious forming bag 50 (FIG. 6) associated with a vacuum source 51. Also disposed in bag 50 is a fiberglass bowl 52 the curvature of which corresponds to the curvature of a concave bottom of shell 16. Bowl 52 has a central circular opening 53 the diameter of which corresponds to that of opening 23 (FIG. 1). Furthermore, there are several small openings in bowl 52 adapted to receive nuts 54 which aid in securing the finished concentrator-pad assembly to the shell.

Figure 7:
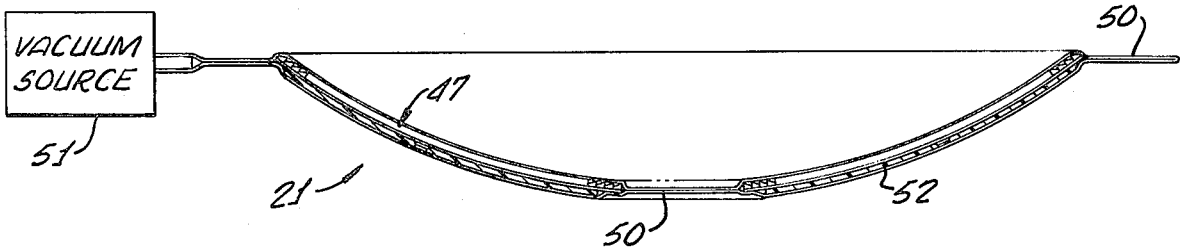

Adhesive (preferably an epoxy resin) is applied to the underside of backing sheet 26 and/or to the upper side of bowl 52, prior to the introduction of these elements into the bag 50, following which vacuum source 51 is employed to reduce the pressure within the bag to such an extent that atmospheric pressure forces pad 47 into conformity with the upper surface of bowl 52 as shown in FIG. 7. The vacuum is maintained until the adhesive has cured, following which the vacuum is released and the thus-attached bowl 52 and pad 47 are removed from bag 50. It is to noted that the system is totally stressed as the back pad has had to increase in area from its original size.

As the next step in the method, the peripheral region of pad 47 is trimmed so that it just reaches the outer edge 56 (FIG. 6) of bowl 52. Correspondingly, the inner portion of the pad 47 is trimmed so that it just reaches the edge or sidewall 57 of bowl opening 53. Exemplary trim lines are shown in phantom at the outer and inner portions of FIG. 4. Thus, the resulting pad 47 has smooth circular outer and inner edges as is greatly preferred.

After the described trimming, the concentrator pad assembly 21 is mounted to the concave bottom region of shell 16. Such concave bottom region is given the number 58 in the fragmentary sectional view of FIG. 8. A bolt 61 is extended through concave bottom 58 and threaded into nut 54 to aid in securing the concentrator-pad assembly in the shell. As described in my copending application filed on even date, the securing is effected primarily by the rim 18 and associated blades 19.

Figure 8:
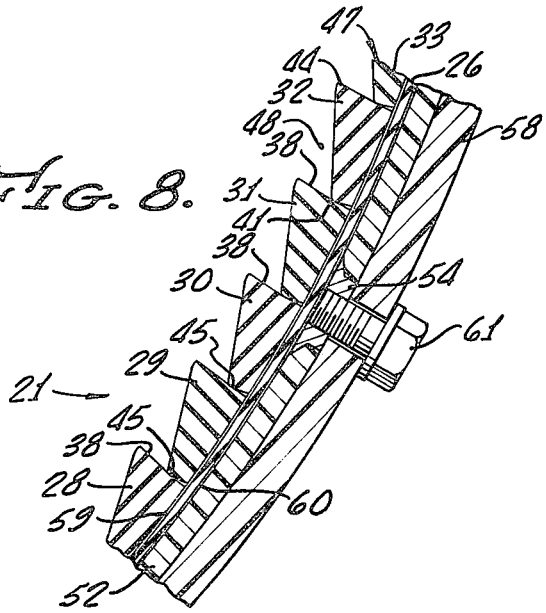
FIG. 8 is a fragmentary sectional view corresponding to FIG. 5 but showing the strips and backing sheet in the configurations assumed when in the concave bowl.

In the showing of FIG. 8, the layer of flexible adhesive which secures strips 28–35 to backing sheet 26 is given the reference numeral 59. The layer of adhesive which secures backing sheet 26 to bowl 52 is given the reference numeral 60.

It is emphasized that the forming of the pad 47 into concave shape, so that it corresponds to the shape of bowl 52, effects increased biting of small teeth 45 into the adjacent surfaces 38. Referring again to FIG. 8, the small teeth 45 not only bite into surfaces 38, to enhance the seals between adjacent teeth, but such small teeth (adjacent edges) act as fulcrums. Thus, the regions of the strips below edges 41 and small teeth 45 tend to separate in response to the forming of growth of pad 47 during forming thereof into the concave shape. Such separation is possible and is not strongly resisted due to the stretchable characteristic of the rubber backing sheet 26. The slight separation of the strip regions below small teeth 45 and edges 41 is necessary. There are very effective seals at the small teeth and edges 41.

The entire concentrator pad assembly 21 is readily removed from bowl 16 by removing bolts 61 (FIG. 8) and also removing blades 19 and rim 18 as described in my co-pending patent application filed on even date herewith. Such removal is effected after long use of the apparatus has created an undesired amount of wear.

It is emphasized that the pad may be formed to any diameter, all without tooling, and all without any necessity for machining. This great breakthrough in pad formation makes it practical to form very large-diameter concentrator pad assemblies having many leads, and desired shapes, as is important in the rapid concentration of very large amounts of ore.

SUMMARY

It is emphasized that strips of molded rubber (preferably extruded rubber) are manufactured with desired cross sections related to the properties of the ore or other substance to be concentrated. Such strips are then nailed to a backing sheet as described relative to FIGS. 2–4 and flexible adhesive is employed to maintain the strips in position after the nails are removed.

Each strip is, during formation of the pad 47, rotated about its associated key nail 46 until it can rotate no more, rotation being stopped when it comes up against the adjacent strip. Such adjacent strip is anchored by its nail or nails 46, and thus can perform the described backup or "stop" function.

As each strip is nailed to the pad and secured thereto by adheisve, the strips themselves start to generate complex curves having unique properties. The outer and inner edges of the strips elongate and compress, respectively.

With the addition of more strips of leads, the curves are unique to the particular series of spiraled strips.

It is possible to extrude very complex shapes and form pads therefrom. It is also possible to cause the strips to have interlocking configurations, or configurations adapted to enhance the adhesive securing to the backing sheet, representative strips being shown in FIGS. 9 and 10. In addition, each strip may have a different shape along its length when (for example) the strips are formed by compression molding or programmed extrusion.

The present method allows pads to be made which could not be machined in the absence of such an expenditure as to make the entire apparatus impractical.

Figure 6:
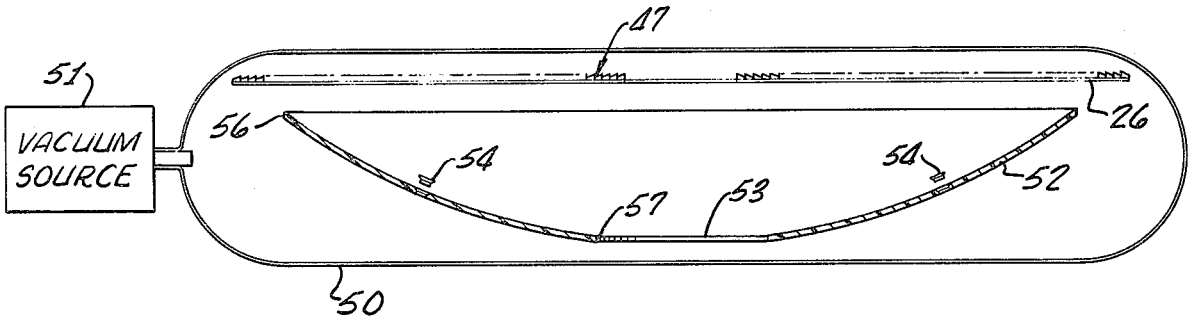
FIGS. 6 and 7 illustrate the vacuum-application of the pad to a concave bowl.

The bowl 52 shown in FIG. 6 could be replaced by some configuration having a complex curvature. The particular curvatures employed for the "bowl" 52, which curvatures are then achieved by the pad 47 during the steps recited relative to FIGS. 6 and 7, are adapted to the particular ore or other substance being concentrated.

EMBODIMENTS OF FIGS. 9 AND 10

As indicated above, one of the complex shapes which may be formed is depicted in FIG. 9. This shows a strip 62 having at one edge thereof a bead adapted to fit into a correspondingly-shaped groove 64 in the other edge thereof, so that the bead may be "popped" into the groove. The illustrated bead is generally cylindrical in section, as is the groove. After such popping, the strips remain closely adjacent each other.

Referring next to FIG. 10, the illustrated strip 66 is shown as having an undercut grooved bottom 67 adapted to receive the adhesive 59 which secures the strip to backing sheet 26. When the rubber cement or other substance which secures the strip to the backing sheet enters groove 67, there is an enhanced securement action created by the groove and the undercut relationship.

EMBODIMENT OF FIGS. 11 AND 12

The present embodiment is not preferred, except for the mass manufacture of very large numbers of integral pads, for example, such as are employed by individual miners as distinguished from commercial operations.

A pad of the desired diameter is formed as described relative to FIGS. 2–4, except that the backing sheet 26 may be omitted. Instead, the various strips 28–35 (or other desired numbers of strips or shapes of strips) are nailed directly to the nail support 27. The strips, when rotated about the illustrated nails 46, generate the complex curves as described above. It is not necessary to employ any adhesive, the nails instead being driven into the strips so as to be flush with the upper surfaces thereof. Thus, the nails 46 shown in FIG. 11 are headless.

Figure 11:
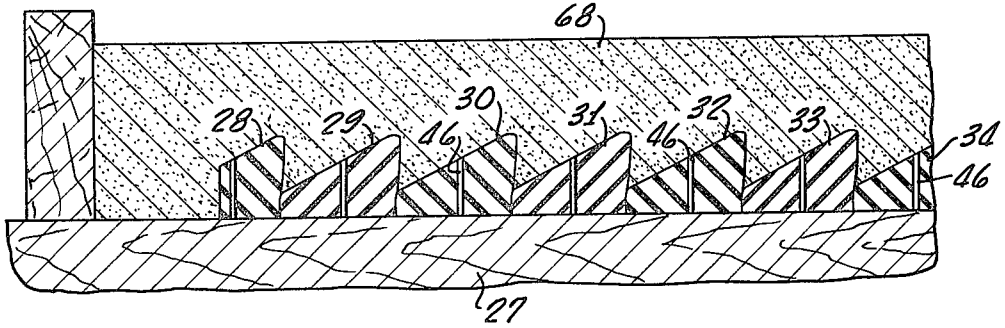
FIG. 11 is a view schematically illustrating plaster of paris poured on the strip-formed pad.
Figure 12:
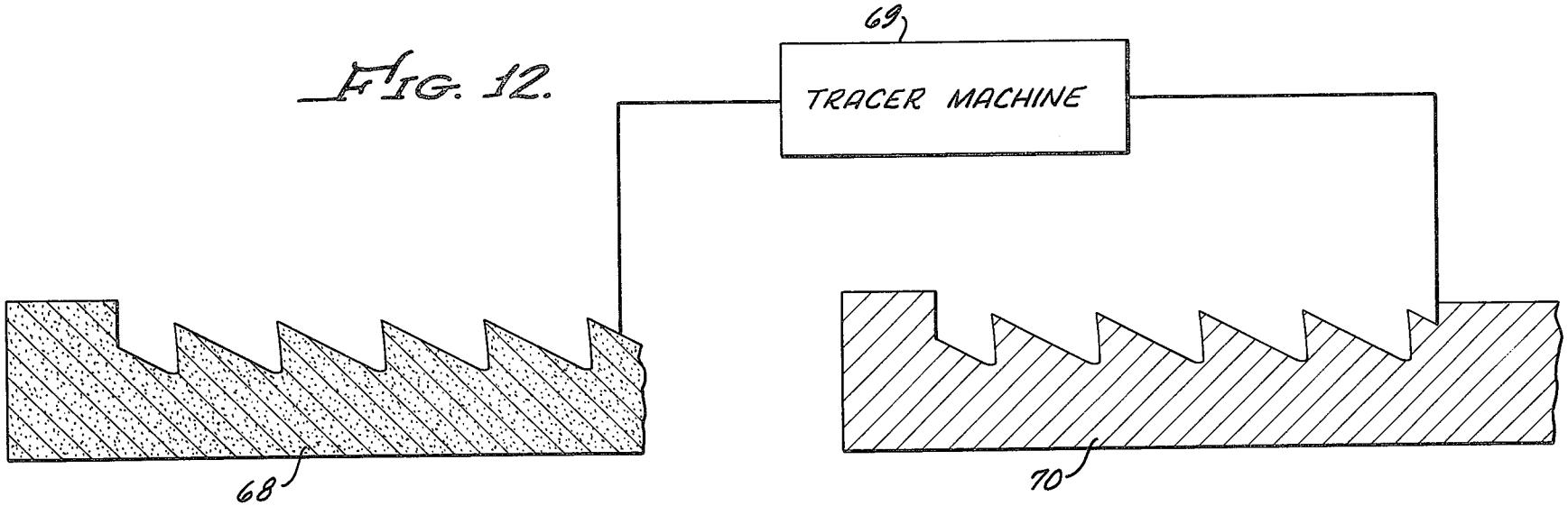
FIG. 12 illustrates schematically the use of the plaster of paris in conjunction with a tracing machine apparatus for forming a mold to be employed in the manufacture of integral pads.

Thereafter, a hardenable substance, such as plaster of paris, is poured over the strips, as illustrated in FIG. 11. The plaster of paris is given the number 68. After the plaster of paris has hardened, it is removed and employed as a template for a tracer machining apparatus, that is to say an apparatus (in the nature of a milling machine) the movements of which are controlled by tracing pattern 68. Such apparatus, (and its association to the plaster of paris element) is illustrated schematically in FIG. 12 and is given the reference numeral 69. In this way, a steel mold 70 may be made and used in the compression or other molding of large numbers of integral rubber pads having the same shape as that of the wound strips 28–35.

The foregoing detailed description is to be clearly understood as given by way of illustration and example only, the spirit and scope of this invention being limited solely by the appended claims.

I claim:

1. In a method of manufacturing an ore-concentrating pad or the like, the steps of:

(a) providing a plurality of elongated flexible strips of predetermined cross-sectional shape,
 said shape being such that grooves will be formed by said strips when said strips are adjacent and parallel to each other, (b) anchoring inner end portions of said strips to an elastomeric support at predetermined locations in a generally circular configuration, while leaving remaining portions of said strips free to move in directions generally parallel to said support, (c) thereafter moving each of said strips into continuous spiraling engagement with the adjacent strip, (d) progressively securing said strips to said support by means of flexible adhesive so that they remain in said continuous engagement, and (e) effecting fluid pressure deformation of said strips and support and into conformity with the concave surface of a relatively rigid, upwardly concave element, and securing said support to said element.

2. The invention as claimed in claim 1, in which said predetermined locations recited in step (b) are equally spaced about a circle.

3. The invention as claimed in claim 2, in which said anchoring is effected by driving a nail through each of said inner end portions and into said support at a point on said circle, said (c) step moving including pivoting of said inner end portions of the strips about said nails.

4. The invention as claimed in claim 1, in which said method comprises effecting progressive securing of each of said strips lengthwise thereof to said support during performance of said step (d) and at regions progressively outwardly-spaced from said anchored inner end portions of said strips.

5. The invention as claimed in claim 1, in which said support comprises a sheet of rubber, and in which said strips are secured to said rubber by flexible adhesive during performance of said step (d).

6. The invention as claimed in claim 5, in which said sheet of rubber is supported on a nail-receiving element, and in which said anchoring is affected by driving nails through said strip and said sheet of rubber into said nail-receiving element.

7. The invention as claimed in claim 1, in which said strips are formed as extrusions each having upper portions so shaped that a generally saw-toothed configuration will be provided on the upper side of the resulting pad.

8. The invention as claimed in claim 1, in which said method further comprises effecting said anchoring step (b) by driving nails through said strip ends at predetermined points about the circumference of a circle on said support, said predetermined points being equally spaced about said circle, said spacing being such that there are predetermined spaces between adjacent strip ends when they are thus nailed and when the extend radially outwardly from said circle, and effecting said step (c) by progressively pivoting said strips about said nails until each of said strips engages and flexes about the next-adjacent strip.

9. A method of making a concentrator pad assembly for a particle concentrator or similar apparatus, comprising the steps of:

(a) employing a plurality of strips secured on a stretchable backer to form a concentrator pad having an upper surface shaped to define concentrating grooves, (b) providing a non-planar and relatively rigid element adapted to receive said pad, (c) providing a layer of adhesive between the underside of said backer and the upperside of said non-planar element, (d) disposing said pad and said relatively-rigid element in a flexible bag, (e) drawing a vacuum on said bag to effect stretching of the backer and air pressure forcing of said stretched backer into engagement with said non-planar element, together with re-orientation of said strips, (f) allowing said adhesive to cure thereby allowing transmission of stresses from the stretched backer to said rigid element, and (g) removing the thus-formed assembly from said bag.

10. The invention as claimed in claim 9, in which said non-planar element is an upwardly-concave bowl having a circular central opening therein.

11. The invention as claimed in claim 10, in which said method further comprises trimming said pad to conform to the edge of said opening and the outer edge of said bowl.

12. A method of making a concentrator pad for an ore concentrator or similar apparatus, comprising:

(a) providing a plurality of flexible strips each having a cross-sectional shape related to the characteristics of the substance to be concentrated, (b) disposing said strips on a backing sheet of rubber, (c) anchoring inner end portions of said strips to said rubber at predetermined locations, while leaving the remaining portions of said strips free to move in directions substantially parallel to said rubber, (d) moving each of said strips to cause it to engage and flex about the adjacent strips, and to be in continuous engagement with the adjacent strip, said step (d) being continued until all of said strips are in engagement with each other, said step (d) further comprising securing the undersides of said strips to said sheet of rubber by means of adhesive which does not become rigid when it cures, (e) effecting fluid-pressure deformation of the assembly of strips and rubber sheet into conformity with the concave surface of a relatively rigid, upwardly-concave element, and (f) securing the thus-bent assembly to said relatively rigid element.

13. The invention as claimed in claim 12, in which said fluid-pressure deformation is effected by disposing said strips and sheet and relatively rigid element in a bag, and drawing a vacuum on said bag to cause atmospheric pressure to deform the contained components into surface engagement with each other, and in which said securing step is effected by means of adhesive.

14. The invention as claimed in claim 1 including molding a hardenable material onto ridges defined by said strips, allowing said material to harden, and employing tracer machine apparatus to trace said ridges on the thus-hardened material and thereby create a mold for mass manufacture of integral pads.

15. A concentrating pad assembly for ores and similar substances, said assembly having been formed by the method of one of claims 1, 9 and 12.

* * * * *